US006842007B2

(12) United States Patent
Butler, Jr. et al.

(10) Patent No.: US 6,842,007 B2
(45) Date of Patent: Jan. 11, 2005

(54) IGNITION COIL DURABILITY TESTING APPARATUS AND METHOD

(75) Inventors: Raymond O. Butler, Jr., Anderson, IN (US); Ronald J. Kiess, Decatur, IN (US)

(73) Assignee: Delphi Technologies, Inc., Troy, MI (US)

( * ) Notice: Subject to any disclaimer, the term of this patent is extended or adjusted under 35 U.S.C. 154(b) by 122 days.

(21) Appl. No.: 10/266,331

(22) Filed: Oct. 8, 2002

(65) Prior Publication Data

US 2004/0066198 A1 Apr. 8, 2004

(51) Int. Cl.[7] ..... F02P 17/00
(52) U.S. Cl. ..... 324/378; 324/546
(58) Field of Search ..... 324/378, 388, 324/546, 547; 123/655, 643

(56) References Cited

U.S. PATENT DOCUMENTS 3,806,796 A * 4/1974 Goldstein ..... 324/384
3,887,866 A * 6/1975 Safer et al. ..... 324/546
4,993,395 A * 2/1991 Vogel et al. ..... 123/655
5,044,349 A * 9/1991 Benedikt et al. ..... 123/655
5,195,496 A 3/1993 Gokhale ..... 123/643
6,035,838 A * 3/2000 Tozzi et al. ..... 123/618
6,556,116 B2 4/2003 Skinner et al. ..... 336/96

OTHER PUBLICATIONS

"Ignition System Measurements Procedure"SAE J973, Society of Automotive Engineers, Inc. dated 1999.

* cited by examiner

*Primary Examiner*—Jay Patidar
*Assistant Examiner*—Timothy J. Dole
(74) *Attorney, Agent, or Firm*—Jimmy L. Funke

(57) ABSTRACT

An ignition coil durability testing apparatus and method utilizing an electronic spark timing circuit, a plurality of SCRs, a plurality of LEDs, and a voltage detection circuit. The electronic spark timing circuit activates an ignition switching transistor which applies a time varying voltage to a primary winding of an ignition coil. The plurality of SCRs are connected in series. A sustaining voltage device in the form of a spark gap or zener box is connected in series with the plurality of SCRs. The secondary winding of the ignition coil is connected to one end of the spark gap or an input of the zener box and to one input of a comparator through a voltage divider and a voltage reference is also connected to the other input of the comparator. When the output voltage of the secondary winding exceeds a preset breakdown voltage, the comparator turns on the plurality of LEDs which activate the plurality of SCRs. The high voltage of the secondary is then applied across the plurality of SCRs and the sustaining voltage device.

19 Claims, 3 Drawing Sheets

IGNITION COIL DURABILITY TESTING APPARATUS AND METHOD

TECHNICAL FIELD

The present invention relates generally to ignition coil durability testing, and more specifically to an ignition coil durability testing apparatus and method which provides a precise breakdown voltage level for durability testing of ignition coils above 15 kilovolts.

BACKGROUND OF THE INVENTION

The magnitude of voltage required to breakdown a spark plug gap depends on many factors including electrode material, electrode shape, gap distance, temperature, chemical composition of the gas in the gap, pressure, and ion concentration in the gap. The durability testing of ignition coils is typically performed by using brass needle point gaps in air at atmospheric pressure. The breakdown voltage to be tested is implemented by varying the gap between the needle points. Once breakdown voltage is achieved, then a sustaining voltage appears across the gap. The needle point gaps work reasonably well on breakdown voltages of up to 15 kilovolts. However, testing above 15 kilovolts with needle point gaps provides a breakdown voltage which may vary as much as plus or minus 5 kilovolts when testing for 25 kilovolts.

SUMMARY OF THE INVENTION

The present invention is an ignition coil durability testing apparatus and method which may be used to test ignition coils with a precise breakdown voltage level.

According to the method of the present invention, an ignition coil to be tested is provided which has a primary winding and a secondary winding, wherein a time varying low voltage is connected to the primary winding. The time varying low voltage induces a time varying high voltage in the secondary winding. When a predetermined value of voltage of the high voltage from the secondary winding is detected, a normally open activation switch is closed in response to detection of the predetermined value of voltage, wherein the closing of the activation switch sends the high voltage through a sustaining voltage device, which may be alternatively in the form of an adjustable spark gap or an adjustable zener box. The activation switch closing is preferably performed by activating at least one light emitting diode to emit light in response to detection of the predetermined value of voltage, and turning on at least one light activated silicon controlled rectifier in response to the emitted light, thereby closing the activation switch. The detection of the predetermined voltage is preferably performed by sensing the high voltage, providing a reference voltage, comparing the sensed voltage to the reference voltage, and sending an initiation signal to initiate closing of the activation switch when the sensed voltage has a predetermined relationship with respect to the reference voltage.

The ignition coil durability testing apparatus preferably includes an electronic spark timing circuit, a coil turn-on transistor, an activation switch in the preferred form of a plurality of light activated silicon controlled rectifiers (SCRs) and a plurality of light emitting diodes (LEDs), and a voltage detection circuit.

An output of the electronic spark timing circuit is connected to the base or gate of the coil turn-on transistor. One end of a primary winding of an ignition coil to be tested is connected to battery positive and the other end is connected to the collector or drain of the coil turn-on transistor. An input of a zener box or one end of a spark gap is connected to a secondary winding of the ignition coil to be tested. The zener box allows a sustaining voltage to be chosen such as to simulate a sustained spark gap voltage as occurs after initial sparking, in, for example, 200 volt increments of from 200 to 1,000 volts. The plurality of light activated SCRs are connected in series. The plurality of LEDs are preferably connected in series, but may be connected in parallel. Each LED is positioned adjacent at least one light activated SCR. The output of the zener box or the other end of the spark gap is connected to one end of the string of light activated SCRs. The other end of the string of light activated SCRs are preferably coupled to ground through a resistor.

The voltage detector circuit preferably includes a comparator, a voltage divider, a reference voltage potentiometer, and an LED turn-on transistor. A negative input terminal of the comparator is connected to the reference voltage potentiometer and a positive input terminal of the comparator is attached to the voltage divider. An output of the comparator is connected to the base or gate of the LED turn-on transistor.

In operation, the electronic spark timing circuit outputs a time varying signal to the coil turn-on transistor. When the coil turn-on transistor is turned-off, the secondary winding of the ignition coil outputs a high voltage. The high voltage of the secondary winding is sensed by the voltage detection circuit, as for example by being divided by the voltage divider to provide a sensed voltage which is then compared by the comparator to the reference voltage. If the sensed voltage is greater than the reference voltage, the voltage detection circuit will signal the activation switch to close, for example by the comparator sending an initiation signal to the LED turn-on transistor which then sinks current and turns on the plurality of LEDs. The light emitted from the plurality of LEDs will turn-on the string of light activated SCRs. Providing the high voltage of the secondary winding is greater than the sustaining voltage of the spark gap or the zener box and the turned on string of light activated SCRs, then the ignition coil will be stressed by voltage across the spark gap or the zener box and the string of light activated SCRs. A high voltage probe may be used to monitor the output voltage of the ignition coil. Normal SCRs could also be used and activated by supplying voltage to a turn on pin using the output of the comparator; however, a light activated SCR will not emit electrical noise to other parts of the ignition coil durability testing circuit.

Accordingly, it is an object of the present invention to provide an ignition coil durability testing method which provides a precise breakdown voltage level over 15 kilovolts for stress testing of an ignition coil.

This and additional objects, features and advantages of the present invention will become clearer from the following specification of a preferred embodiment.

DESCRIPTION OF THE PREFERRED EMBODIMENT

Figure 1:
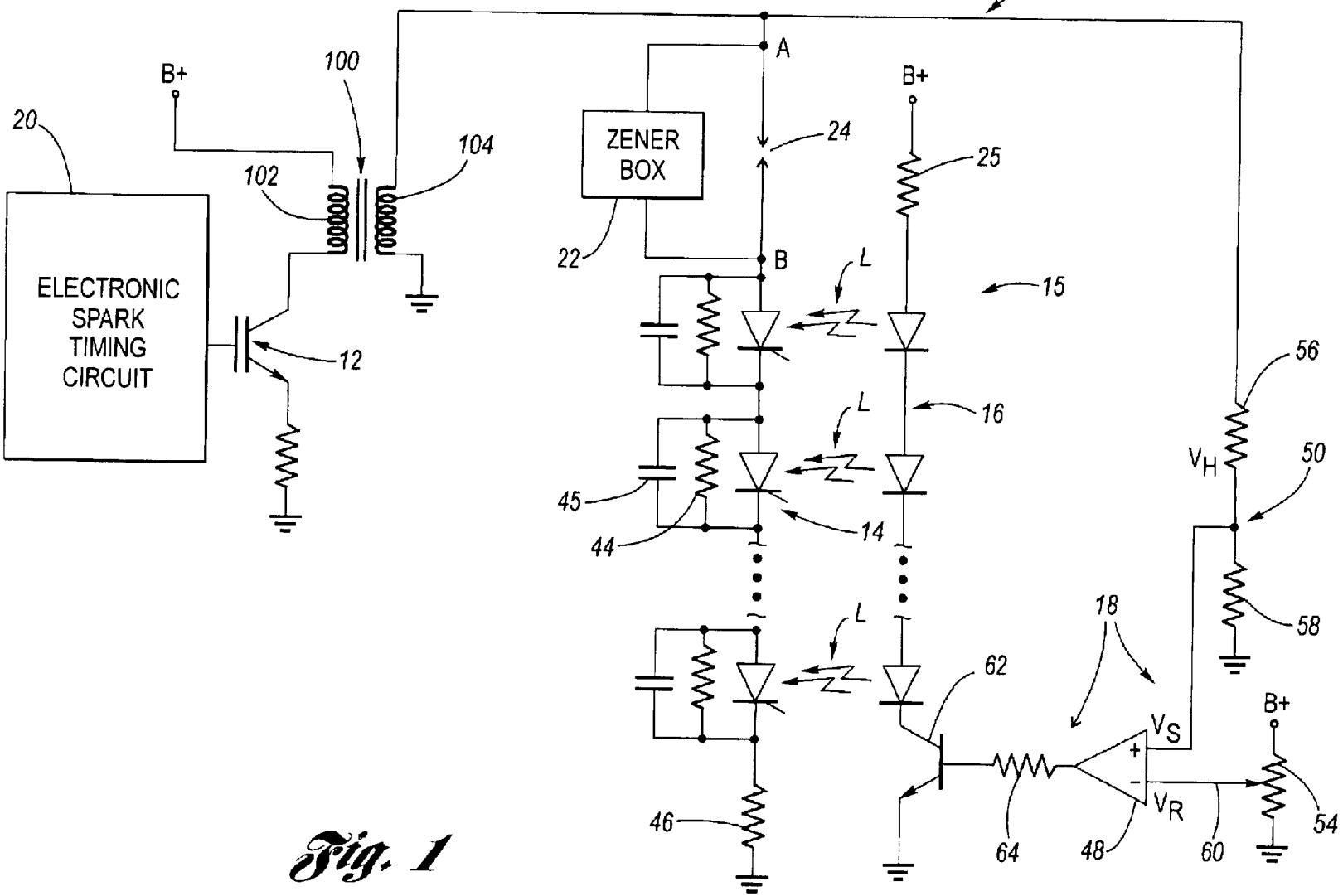
FIG. 1 is an electrical schematic of an ignition coil durability testing method according to the present invention.

According to the method of the present invention, an ignition coil 100 to be tested is provided which has a primary winding 102 and a secondary winding 104, wherein a time varying low voltage is connected to the primary winding, as for example by an electronic spark timing circuit 20. The time varying low voltage induces a time varying high voltage in the secondary winding. When a predetermined value of voltage of the high voltage from the secondary winding is detected by a voltage detection circuit 18, a normally open activation switch 15 is closed in response to detection of the predetermined value of voltage, wherein the closing of the activation switch sends the high voltage through a sustaining voltage device, which may be alternatively in the form of an adjustable spark gap 24 or an adjustable zener box 22. The activation switch closing step is preferably performed by activating at least one light emitting diode 16 to emit light in response to detection of the predetermined value of voltage, and turning on at least one light activated silicon controlled rectifier 14 in response to the emitted light, thereby closing the activation switch 15. The detection of the predetermined voltage step is preferably performed by sensing the high voltage from the secondary winding, such as for example by a voltage divider 50 (consisting of first and second resistors 56, 58), providing a reference voltage, such as for example by a reference voltage potentiometer 54, and then comparing the sensed voltage to the reference voltage, such as for example by a comparator 48, wherein when the sensed voltage has a predetermined relationship with respect to the reference voltage, then the predetermined value of voltage has been detected and an initiation signal is sent to initiate closing of the activation switch.

With regard to the apparatus according to the present invention, FIG. 1 shows an electrical schematic for ignition coil durability testing according to the present invention. An ignition coil durability testing circuit 10 includes an electronic spark timing circuit 20, a coil turn-on transistor 12, an activation switch 15 in the form of a plurality of light activated SCRs 14 and a plurality of LEDs 16, and a voltage detection circuit 18. An output of the electronic spark timing circuit 20 is connected to the base or gate of the coil turn-on transistor 12. The electronic spark timing circuit 20 may be any voltage signal generation device which outputs a suitable time varying electrical signal. One end of a primary winding 102 of an ignition coil 100 to be tested is connected to battery positive and the other end is connected to a collector or drain of the coil turn-on transistor 12. An input of a sustaining voltage device, either for example a zener box 22 or alternatively a spark gap 24, is connected to a secondary winding 104 of the ignition coil 100 to be tested. The zener box 22 and the spark gap 24 are each adjustable sustaining voltage devices, wherein the zener box may be used, for example, to simulate sustained spark voltage which is of a value lower than that required to commence sparking. The zener box 22 may be adjusted to provide sustaining voltages in, for example, 200 volt increments of from 200 to 1,000 volts. A gap distance between the points of the spark gap 24 may be adjusted to produce varying sustaining voltages.

Figure 2:
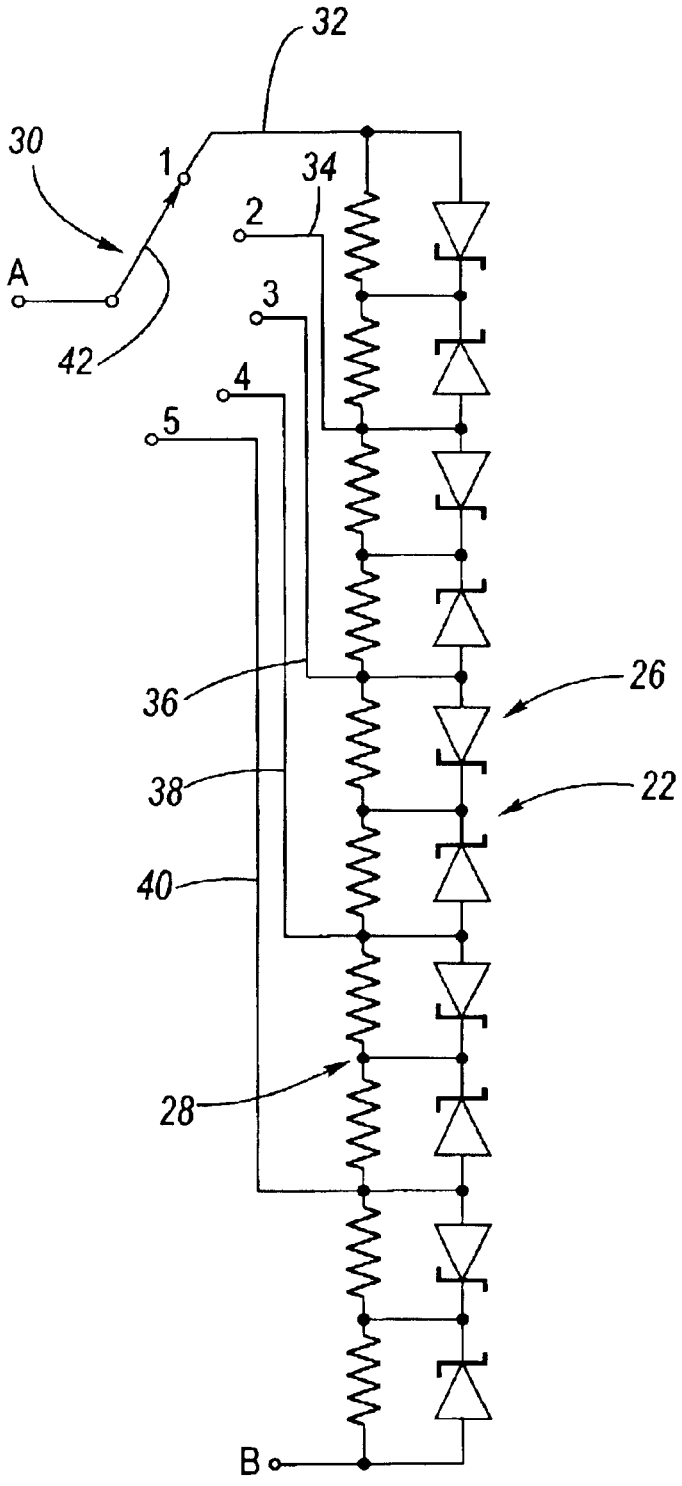
FIG. 2 is an electronic schematic of a switchable rectifier circuit of the ignition coil durability testing method according to the present invention.

With reference to FIG. 2, the zener box 22 includes a plurality of zener diodes 26, a plurality of resistors 28, and a rotary switch 30. Each 200 volt increment is implemented by connecting the anodes of two respective zener diodes 26. A single resistor 28 is respectively connected in parallel with each zener diode 26. The cathode of each zener diode 26 is connected to a selected selector line 32–40. Each selector line is connected to a respective pole of the rotary switch 30. The sustaining voltage of the zener box 22 is chosen by connecting a wiper 42 of the rotary swtich 30 to a particular pole thereof. For example: connecting the wiper 42 to a first selector line 32 provides a breakover voltage of 1,000 volts; connecting the wiper 42 to a second selector line 34 provides a break-over voltage of 800 volts; connecting the wiper 42 to a third selector line 36 provides a break-over voltage of 600 volts; connecting the wiper 42 to a fourth selector line 38 provides a break-over voltage of 400 volts; and connecting the wiper 42 to a fourth selector line 38 provides a break-over voltage of 200 volts. Preferably, 1N6303A type zener diodes are used in the zener box 22, having a break-over voltage of 200 volts. The resistors 28 have a preferable value of 1 mega-ohm.

The plurality of light activated SCRs 14 are connected in series and act as one switch, wherein the stand-off voltage of the sum of the SCRs (when not turned on) plus the break-over voltage of the sustaining voltage device exceeds the high voltage of the secondary winding; for example, each SCR may have a stand-off voltage of 1,000 volts. An output of the zener box 22 or the other end of the spark gap 24 is connected to the plurality of light activated SCRs 14. Preferably, a drain resistor 44 is connected in parallel with each light activated SCR 14 as protection against over voltage damage (see FIG. 1) so as to, for example, drain current from an over voltage spike. Each drain resistor 44 preferably has a value of 500 kilo-ohms; however, other resistance values may also be used. A single capacitor 45 may also be connected in parallel with each drain resistor 44 (see FIG. 1). The capacitor 45 is used in parallel with the drain resistor 44 to accommodate variations of reverse impedance and junction capacitance experienced by the plurality of light activated SCRs 14 during voltage transients. Other devices such as back to back zener diodes or varistors may be added in parallel or substituted for the capacitor 45. Each one of the plurality of LEDs 16 must be located adjacent at least one light activated SCR 14, such that light emitting from the light emitting diode 16 turns on the light activated SCR 14. The plurality of LEDs 16 are connected to a current control resistor 25 and are preferably connected in series, but may be connected in parallel. The other end of the string of light activated SCRs 14 are preferably coupled to ground through a resistor 46.

The voltage detection circuit 18 senses the high voltage at the secondary winding, compares this sensed voltage to a reference voltage and then initiates closure (turn-on) of the activation switch 15 in the event a predetermined relationship therebetween is present. An example of a voltage detection circuit 18 includes a comparator 48, a voltage divider 50, a reference voltage potentiometer 54, and an LED turn-on transistor 62. A negative input terminal of the comparator 48 is connected to the reference voltage potentiometer 54 and a positive input terminal of the comparator 48 is attached to the voltage divider 50. The voltage divider 50 includes a first resistor 56 and a second resistor 58. The value of the sensed voltage $V_S$ at the positive terminal of the comparator 48 is defined by the resistance of the second resistor 58 divided by the sum of the resistances of the first resistor 56 and the second resistor and then multiplied by the high voltage $V_H$ of the secondary winding 104:

$$V_S=(R_{58}/(R_{56}+R_{58}))\times V_H.$$

By way of exemplification, the resistance value of the first resistor 56 is 10,000 times the resistance value of the second resistor 58 in order to prevent damage to the comparator 48. Preferably, the first resistor 56 has a value of 100 megaohms and the second resistor 58 has a value of 10 kilo-ohms. The voltage reference potentiometer 54 includes a tap 60 which is connected to the negative terminal of the comparator 48. The tap 60 is adjusted to provide a proper reference voltage $V_R$ to the comparator 48 such that the comparator provides an initiation signal which turns on the LED turn-on transistor 62 when the voltage at the positive terminal is greater than the voltage at the negative terminal. In this regard, the output of the comparator 48 is connected to a base or gate of the LED turn-on transistor 62 through a resistor 64, which is provided to establish a base current of the LED turn-on transistor 62.

In operation, the electronic spark timing circuit 20 outputs a time varying signal, as for example a square wave, to the coil turn-on transistor 12, which thereupon sends a time varying low voltage to the primary winding 102, and thereby induces a high voltage in the secondary winding 104, wherein the high voltage from the secondary winding is output as the coil turn-on transistor 12 is turned-off with the falling edge of the time varying signal. The time varying high voltage of the secondary winding 104 is sensed, via the voltage divider 50, at the comparator. If the sensed voltage $V_S$ is greater than the reference voltage $V_R$, then the comparator 48 will output an initiation signal that turns on the LED turn-on transistor 62. The LED turn-on transistor 62 will sink current and turn on the plurality of LEDs 16. The light L emitted from the plurality of LEDs 16 will turn on the string of light activated SCRs 14, thereby closing the activation switch 15. Assuming the high voltage $V_H$ of the secondary winding 104 is greater than the sustaining voltage of the spark gap 24 or zener box 22 and the turned on string of light activated SCRs 14, then the ignition coil 100 will be stressed by voltage across the spark gap 24 or the zener box 22 and the turned on string of light activated SCRs 14. A high voltage probe may be used to monitor the output voltage of the secondary winding 104.

Figure 3:
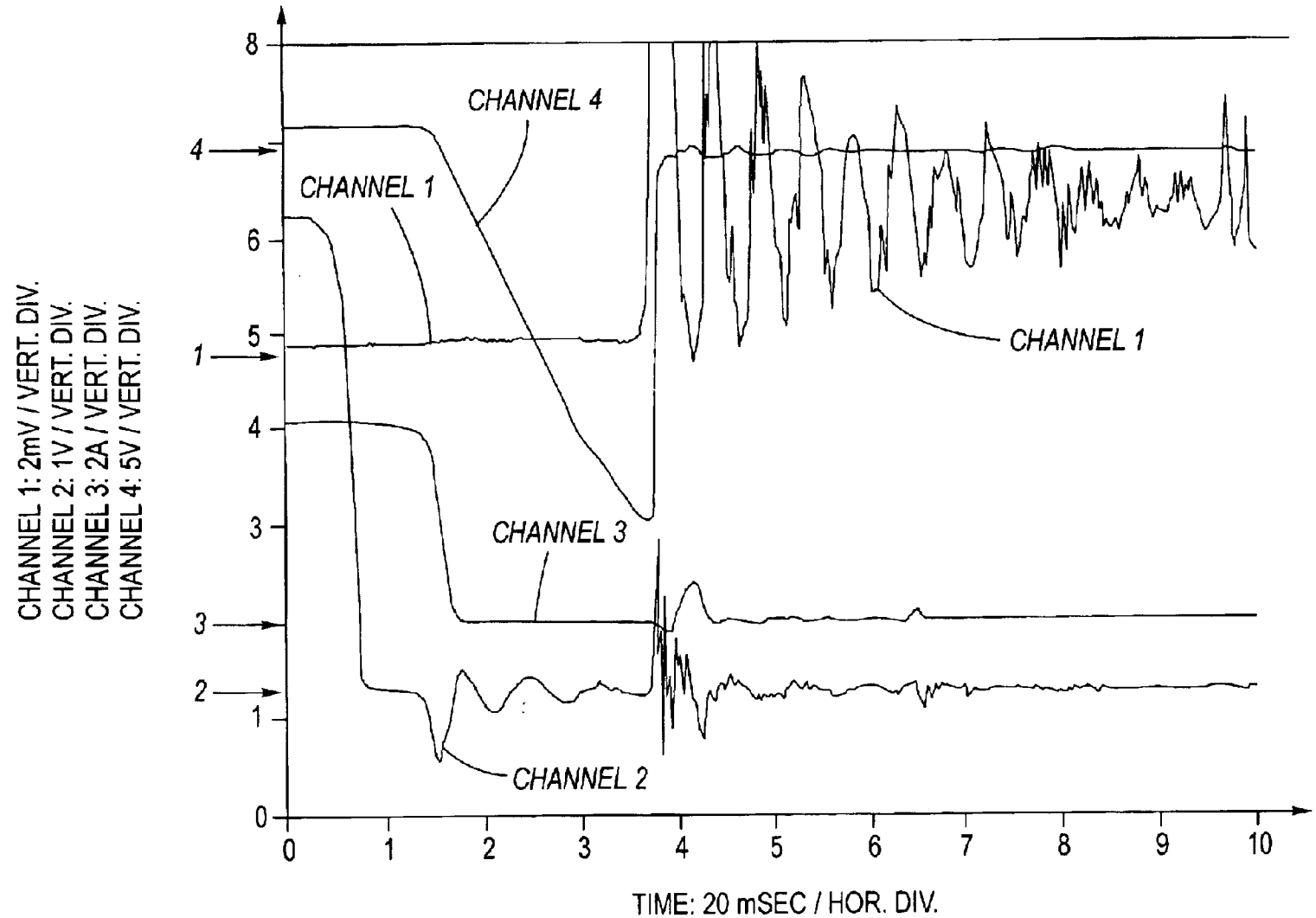
FIG. 3 is an oscilloscope screen print-out showing the voltage and current output of an ignition coil of the ignition coil durability testing method according to the present invention.

FIG. 3 shows an oscilloscope trace of an ignition coil being activated to test the durability thereof. The current of the secondary winding 104 is shown by channel 1; the output of the electronic spark timing circuit 20 is shown by channel 2; the primary current of the primary winding 102 is shown by channel 3; and the secondary voltage of the secondary winding 104 is shown by channel 4. On the fall of a square wave signal output from the electronic timing circuit 20, a negative secondary voltage of approximately 20 kilovolts is output from the secondary winding 104. The secondary voltage is shown as 5 kilovolts per division on the oscilloscope trace. The coil turn-on transistor 12 is turned off when the time varying signal falls to zero. Thus, the primary current in channel 3 falls from 4 amps to 0 amps.

To those skilled in the art to which this invention appertains, the above described preferred embodiment may be subject to change or modification. For example, other light activated solid state components having light activation turn on properties can be used in place of the SCRs, as for example light sensitive phototriac devices capable of operating at voltages up to, for example, 40 kilovolts. Also, electrical components may be included with the circuit of FIG. 1 so that voltage is inverted as desired. Such change or modification can be carried out without departing from the scope of the invention, which is intended to be limited only by the scope of the appended claims.

What is claimed is:

1. A method of testing ignition coils for durability, comprising the steps of:

providing a testing circuit that comprises a voltage detector for detecting a voltage, means for comparing the detected voltage to a reference voltage, and means for adjusting the reference voltage to a predetermined value;

providing an ignition coil to be tested, wherein the ignition coil has a primary winding and a secondary winding;

providing a time varying low voltage to the primary winding, wherein the time varying low voltage induces a time varying high voltage in the secondary winding;

detecting the time varying high voltage using said voltage detector and determining when said time varying high voltage exceeds the predetermined value;

closing a normally open activation switch in response to determination that said time varying high voltage exceeds said predetermined value, wherein said closing of said activation switch sends the high voltage through a sustaining voltage device.

2. The method of claim 1, further comprising adjusting the sustaining voltage of the sustaining voltage device.

3. The method of claim 2, wherein said step of adjusting the sustaining voltage comprises adjusting at least one of a spark gap and a zener box.

4. The method of claim 1, wherein said step of closing comprises:

activating at least one light emitting diode to emit light in response to detection of the predetermined value of voltage; and turning on at least one light activated solid state component in response to the emitted light which thereby closes the activation switch.

5. The method of claim 1, wherein said step of detecting comprises:

sensing the high voltage;

providing a reference voltage; and comparing the sensed voltage to the reference voltage, wherein when the sensed voltage has a predetermined relationship with respect to the reference voltage, the predetermined value of voltage is detected.

6. The method of claim 1, wherein said step of closing comprises:

activating at least one light emitting diode to emit light in response to detection of the predetermined value of voltage; and turning on at least one light activated silicon controlled rectifier in response to the emitted light, thereby closing the activation switch.

7. The method of claim 6, wherein said step of detecting comprises:

sensing the high voltage;

providing a reference voltage; and comparing the sensed voltage to the reference voltage, wherein when the sensed voltage has a predetermined relationship with respect to the reference voltage, the predetermined value of voltage is detected.

8. The method of claim 7, further comprising adjusting the sustaining voltage of the sustaining voltage device.

9. The method of claim 8, wherein said step of adjusting the sustaining voltage comprises adjusting at least one of a spark gap and a zener box.

10. An electronic device durability testing circuit for testing an ignition coil having a primary winding and a secondary winding such that a time varying low voltage applied to the primary winding induces a time varying high voltage in the secondary winding, comprising:

a source of time varying voltage adapted for connection to the primary winding of the ignition coil to be tested;

a test connection adapted for connection to the secondary winding of the ignition coil to be tested;

a voltage detector for detecting a voltage at the test connection and for determining when the sensed voltage is greater than a reference voltage, said voltage detector further comprising means for adjusting the reference voltage to a predetermined value;

a sustaining voltage device connected to the test connection; and an activation switch connected to the test connection and responsively connected to the voltage detector, said activation switch having a normally open state and a closed state, wherein said activation switch switches from the open state to the closed state responsive to said voltage detector detecting a voltage greater than the predetermined value;

wherein current from the test connection can only pass through the sustaining voltage device when said activation switch is in the closed state.

11. The testing circuit of claim 10, wherein said activation switch comprises:

at least one light emitting diode which emits light in response to said voltage detector detecting the predetermined value of voltage; and at least one light activated solid state device which turns on in response to the emitted light and thereby provides the closed state of the activation switch.

12. The testing circuit of claim 10, wherein said voltage detector comprises:

a voltage divider connected to the test connection, said voltage divider providing a sensed voltage divided from a voltage applied to the test connection;

a source of a reference voltage; and a comparator comparing the sensed voltage to the reference voltage, wherein when the sensed voltage has a predetermined relationship with respect to the reference voltage, the predetermined value of voltage is detected.

13. The testing circuit of claim 10, wherein said sustaining voltage device comprises an adjustable air gap.

14. The testing circuit of claim 10, wherein said sustaining voltage device comprises an adjustable zener box.

15. The testing circuit of claim 14, wherein said zener box comprises:

a plurality of zener diodes arranged as a plurality of pairs of zener diodes, wherein the zener diodes of each pair are mutually connected at the anode thereof, and wherein the cathodes of each pair of zener diodes are connected to a respective lead; and a plurality of resistors, one resistor respectively for each zener diode, wherein each resistor is respectively connected in parallel with each zener diode;

wherein adjustment is made by selection of a respective lead with respect to the test connection.

16. The testing circuit of claim 10, wherein said activation switch comprises:

a plurality of mutually interconnected light emitting diodes, each light emitting diode emitting light in response to said voltage detector detecting the predetermined value of voltage; and a plurality of mutually interconnected light activated silicon controlled rectifiers, at least one light activated silicon controlled rectifier for each said light emitting diode, wherein each light activated silicon controlled rectifier turns on in response to the emitted light from the light emitting diodes and thereby provides the closed state of the activation switch.

17. The testing circuit of claim 16, wherein said voltage detector comprises:

a voltage divider connected to the test connection, said voltage divider providing a divided voltage which is proportional to a voltage applied to the test connection a source of a reference voltage; and a comparator comparing the divided voltage to the reference voltage, wherein when the divided voltage has a predetermined relationship with respect to the reference voltage, the predetermined value of voltage is detected.

18. The testing circuit of claim 17, wherein said sustaining voltage device comprises an adjustable air gap.

19. The testing circuit of claim 17, wherein said sustaining voltage device comprises an adjustable zener box, wherein said zener box comprises:

a plurality of zener diodes arranged as a plurality of pairs of zener diodes, wherein the zener diodes of each pair are mutually connected at the anode thereof, and wherein the cathodes of each pair of zener diodes are connected to a respective lead; and a plurality of resistors, one resistor respectively for each zener diode, wherein each resistor is respectively connected in parallel with each zener diode;

wherein adjustment is made by selection of a respective lead with respect to the test connection.

* * * * *